United States Patent [19]

Clancy et al.

[11] Patent Number: 4,594,812

[45] Date of Patent: Jun. 17, 1986

[54] SLIDING DOOR CONSTRUCTION

[75] Inventors: Joseph S. Clancy, Union Lake; Robert J. Heideman, Westland, both of Mich.

[73] Assignee: Sash Controls, Inc., Ferndale, Mich.

[21] Appl. No.: 667,447

[22] Filed: Nov. 1, 1984

[51] Int. Cl.[4] ..... E05D 15/06

[52] U.S. Cl. ..... 49/404; 49/501; 49/504; 52/727

[58] Field of Search ..... 49/404, 501, 504; 52/727, 730, 207

[56] References Cited

U.S. PATENT DOCUMENTS

| | | | |
|---|---|---|---|
| 3,348,349 | 10/1967 | Petersen | 52/727 X |
| 3,491,584 | 1/1970 | Selzer | 52/727 X |
| 3,530,618 | 9/1970 | Grossman | 49/501 |
| 4,207,707 | 6/1980 | Holdman et al. | 49/501 |
| 4,227,346 | 10/1980 | Kubik | 49/501 X |
| 4,479,331 | 10/1984 | Bertolami et al. | 52/727 X |

*Primary Examiner*—Kenneth Downey
*Attorney, Agent, or Firm*—Krass and Young

[57] ABSTRACT

A cladding and sealing kit for use with a sliding door construction in which a plurality of cladding and sealing members are sealingly engaged with the various wooden frame members forming the door opening and forming the frame of the doors to readily clad the various exposed surfaces and provide sealing between the various sliding interfaces. Each cladding and sealing member includes an elongated flat main body portion defining a longitudinal front face and a longitudinal rear face adapted to be placed against a longitudinal side surface of an elongated wooden frame member; a longitudinal fulcrum rib portion extending from the rear face of the main body portion and angled toward one of the main body portion for coaction with a complimentarily angled longitudinal slot formed in the longitudinal wooden member; a longitudinal cantilever flange portion extending generally perpendicularly away from the rear face of the main body portion adjacent the one end of the main body portion and defining a longitudinal inner face confronting the fulcrum rib portion; and a longitudinal lip portion formed adjacent the free end of the cantilever flange portion and extending from the inner face of the cantilever flange portion toward the fulcrum rib portion for coaction with a complimentary longitudinal slot formed in a longitudinal edge surface of the elongated wooden member. The cladding and sealing members are snappingy and removably secured to the longitudinal side surface of the respective wooden member by inserting the fulcrum rib portion into the angled slot in the longitudinal side face of the respective wooden member and pivoting the cladding member about the fulcrum rib portion to cam the leading edge of the cantilever flange portion over the corner of the wooden member and snap the lip portion into the slot in the edge surface of the wooden member.

18 Claims, 6 Drawing Figures

SLIDING DOOR CONSTRUCTION

BACKGROUND OF THE INVENTION

This invention relates to sliding sash constructions and, more particularly, to a cladding and sealing kit for use with a sliding door or window construction.

Sliding door constructions, typically comprising one fixed door and one sliding door, are in common use in both residential and commercial environments. A myriad of different constructions have been proposed for sliding doors in an attempt to provide a sliding door construction that is inexpensive to initially produce, inexpensive to maintain, attractive in appearance, effective from a weather sealing standpoint, readily removable for replacement or repair, and compatible with inventory requirements of dealers and distributors. Whereas several generally satisfactory constructions have been proposed and/or utilized, each of the prior art constructions suffers from one or more disadvantages. Specifically, whereas several low-cost designs have been proposed, these designs tend to be unattractive in appearance and/or fail to provide effective weather sealing. Conversely, whereas several of the prior art designs provide an attractive appearance and offer effective weather sealing, these designs tend to be overly complex and, accordingly, embody high initial cost and/or high maintenance costs and impose untenable inventory requirements.

SUMMARY OF THE INVENTION

The present invention is directed to a sliding sash construction that is low in initial cost, attractive in appearance, compatible with commercial inventory requirements, low in maintenance cost, and that provides effective weather sealing.

The present invention satisfies these objects by the provision of a cladding and sealing kit for use with a sliding door or window construction to which a plurality of cladding and sealing members are snappingly engaged with the various wooden frame members forming the door opening and forming the frames of the doors to readily clad the various exposed surfaces and, at the same time, provide sealing between the various sliding interfaces.

Each cladding and sealing member according to the invention includes an elongated flat main body portion defining a longitudinal front face and a longitudinal rear face adapted to be placed against a longitudinal side surface of an elongated wooden frame member; a longitudinal fulcrum rib portion extending from the rear face of the main body portion and angled toward one end of the main body portion for coaction with a complimentarily angled longitudinal slot formed in the longitudinal side surface of the wooden member; a longitudinal cantilever flange portion extending generally perpendicularly away from the rear face of the main body portion adjacent the one end of the main body portion and defining a longitudinal inner face confronting the fulcrum rib portion; and a longitudinal lip portion formed adjacent the free end of the cantilever flange portion and extending from the inner face of the cantilever flange portion toward the fulcrum rib portion for coaction with a complimentary longitudinal slot formed in a longitudinal edge surface of the elongated wooden member forming a corner with the longitudinal side surface of that member. With this arrangement, the cladding and sealing member may be snappingly and removably secured to the longitudinal side surface of respective wooden members by inserting the angled fulcrum rib portion into the angled slot in the longitudinal side face of the respective wooden member and pivoting the cladding member about the fulcrum rib portion to cam the leading edge of the cantilever flange portion over the corner of the wooden member and snap the lip portion into the slot in the edge surface of the wooden member. The cladding and sealing member may thus be readily applied to the respective wooden member and may be readily removed from that member in the event the initial installation is unsatisfactory, in the event a later decision is made to provide an opposite hand door, or in the event that maintenance or repair is later required.

According to a further feature of the invention, each cladding and sealing member further includes a longitudinal flexing flange portion extending generally perpendicularly from the front face of the main body portion at the one end thereof and a longitudinal web portion interconnecting the free end of the flexing flange portion and the end of the cantilever portion remote from the free end thereof. With this arrangement, the flexing flange portion, the web portion, and the cantilever flange portion resiliently and flexingly coact during securement of the cladding and sealing member to the wooden member to facilitate the caming movement of the free end of the cantilever flange portion over the corner of the wooden member for snapping engagement of the lip portion in the slot in the edge surface of the wooden member.

According to a further feature of the invention, at least certain of the cladding and sealing members further include a sealing portion defining a longitudinal seat groove adjacent the front face of the main body portion adapted to receive a longitudinal seal for sliding coaction with a longitudinal surface on one of the sliding doors. The cladding and sealing members thus perform both a cladding and sealing function.

According to a further feature of the invention, at least certain of the cladding and sealing members further include another sealing portion defining another longitudinal seat groove adjacent the front face of the main body portion in spaced, confronting relation to the first seat groove with the confronting seat grooves being adapted to receive longitudinal seals for respective coaction with opposite longitudinal surfaces on the sliding door.

According to yet another feature of the invention, with respect to certain of the cladding and sealing members adapted for securement to confronting longitudinal surfaces at the sealing interface between the sliding doors, the longitudinal seat groove is defined directly on the front face of the main body portion and a longitudinal weatherstrip portion extends from the front face of the main body portion between the flexing flange portion and the seat groove. The weatherstrip portion includes a wedge portion generally overlying the seat groove and defining an inner longitudinal sealing surface for caming and sealing coaction with a similar surface on a further cladding and sealing member secured to the other door and an outer longitudinal sealing surface for sealing coaction with the longitudinal seal received in the seat groove of the further cladding and sealing member.

DETAILED DESCRIPTION OF THE PREFERRED EMBODIMENT

Figure 1:
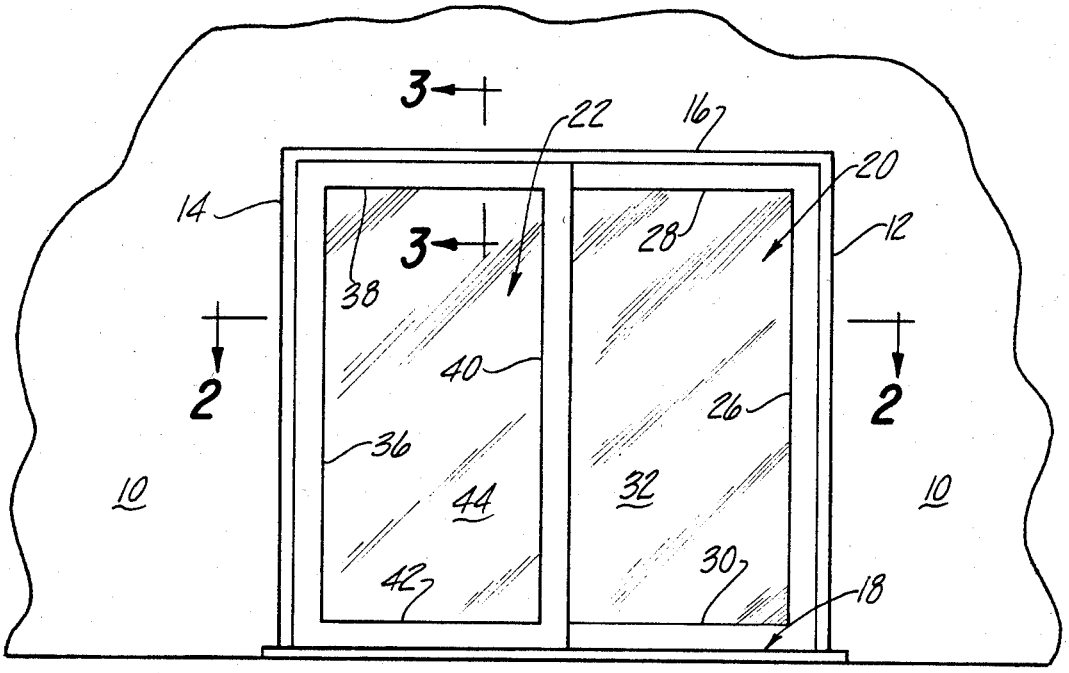
FIG. 1 is a simplified view of a sliding door assembly embodying the invention cladding and sealing kit.

Whereas the invention is illustrated in the drawings and hereinafter described with particular reference to a sliding door construction, it will be understood that the invention is applicable to any sliding sash construction, including windows or doors.

The sliding door assembly as seen in FIG. 1 is positioned in the outer wall 10 of a building and includes a right jamb member 12, a left jamb member 14, a header member 16, a sill 18, a sliding door unit 20, and a fixed door unit 22.

Sliding door unit 20 includes a left side frame member or stile 24, a right side frame member or stile 26, a top frame or rail member 28, a bottom frame or rail member 30, and a glass pane 32 sealingly mounted in suitable grooves in the four frame members as by putty or glazing 34.

Fixed door unit 22 includes a left side frame member or stile 36, a top frame or rail member 38, a right side frame member or stile 40, a bottom frame or rail member 42, and a glass pane 44 mounted in suitable grooves in the four frame mbmers as by putty or glazing 46.

In general assembly, jamb members 12 and 14 and header 16 are suitable secured in the opening in the exterior wall 10 of the building whereafter fixed door unit 22 is fixedly positioned in the left hand half of the door opening and sliding door unit 20 is mounted on a track 47 formed on sill 18. Sliding door unit 20 is movable on track 47 between a closed position in which the right side frame member 26 is juxtaposed to jamb member 12 and an open position in which left side frame member 24 is juxtaposed to jamb member 14. This invention concerns a cladding and sealing kit whereby the various wooden frame members of the door opening and door units are clad and whereby sealing is effected between the door units and between the door units and the door frame assembly.

The invention kit comprises a plurality of elongated cladding and sealing members or strips which are snappingly secured to the door opening and to the door frames and which, when thus secured, provide protection for exposed surfaces of the wooden members and sealing between the fixed and sliding members. The kit comprises a strip 48 for coaction with door jamb 12; a strip 50 for coaction with header 16; a strip 52 for coaction with jamb member 14; a strip 54 for coaction with fixed door right side frame member 40; and a strip 56 for coaction with sliding door left side frame member 24. Each of the strips may be formed for example of a suitable flexible vinyl material and each of the strips is preferably formed in an extruding operation.

Strip 48 includes a main body portion **48*a* defining a front face 48*b* and a rear face 48*c*; a fulcrum rib portion 48*d* extending from the rear face of the main body portion and angled toward the end 48*e* of the main body portion; a flexing flange portion 48*f* extending generally perpendicularly from the front face of the main body portion at the end 48*e* thereof; a cantilever flange portion 48*g* extending generally perpendicularly away from the rear face of the main body portion adjacent end 48*e*; a lip portion 48*h* formed adjacent the free end of cantilever flange portion 48*g* and extending from the inner face of the cantilever flange portion toward the fulcrum rib portion 48*d*; a web portion 48*i* interconnecting the free end of flexing flange portion 48*f* and the end of cantilever flange portion 48*g* remote from lip portion 48*h*; a sealing portion 48*j* extending from the front face of the main body portion adjacent main body portion end 48*e* and defining a sealing groove 48*k*; and another sealing portion 48*l* extending from the front face of the main body portion adjacent main body portion end 48*m* and defining a sealing groove 48*n* confronting sealing groove 48*k***.

Figure 5:
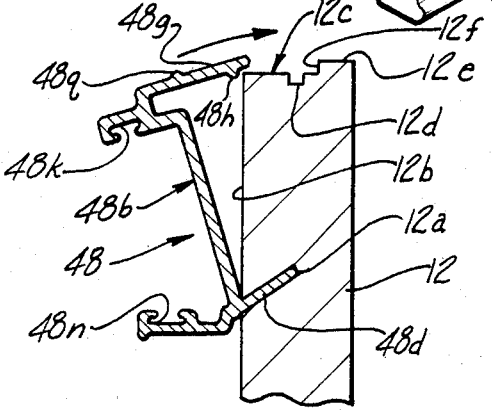
FIG. 5 is a fragmentary view showing the snapping installation of a cladding and sealing member according to the invention onto a wooden frame member of the sliding door assembly.
Figure 6:
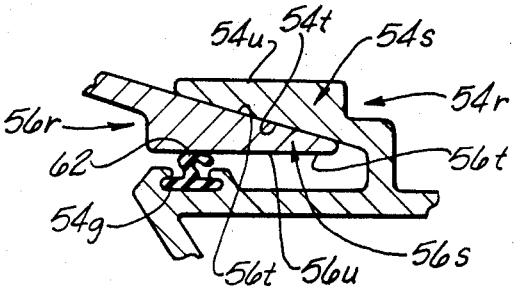
FIG. 6 is a fragmentary detail view of a cladding and sealing member according to the invention particularly suited for use at the interface between the sliding and fixed doors of the sliding door assembly.

In assembly, and as best seen in FIG. 5, the fulcrum rib portion **48*d* is inserted in a complimentarily angled longitudinal slot 12*a* formed in the exposed longitudinal surface 12*b* of jamb member 12, whereafter the strip is pivoted about the fulcrum rib portion 48*d* to cam the leading edge of the cantilever flange portion 48*g* over the corner 12*c* of the jamb member and snap lip portion 48*h* into a longitudinal slot 12*d* formed in the edge surface 12*e* of the jamb member. Edge 12*e* is preferably milled away at 12*f* so that the cantilever flange portion when snappingly secured to edge 12*e* is positioned flush with the unmilled portion of end surface 12*e*. Thus secured to jamb member 12, cladding and sealing strip 48 clads longitudinal surface 12*b* and edge surface of the jamb member and presents confronting sealing grooves 48*k* and 48*n* for receipt of suitable elongated seals 58 which slidably and sealingly engage the right side frame member 26 of the sliding door assembly as that door reaches its closed position in juxtaposition to jamb member 12. A stop member 59 suitably secured to jamb member 12 through cladding and sealing member 48** determines the closed position of the sliding door.

Figure 3:
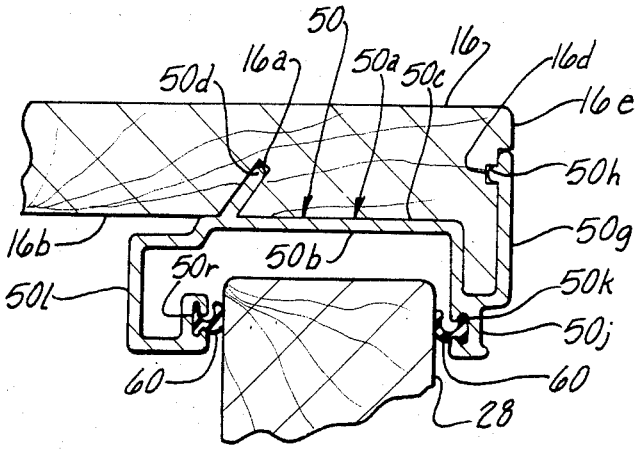
Figure 4:
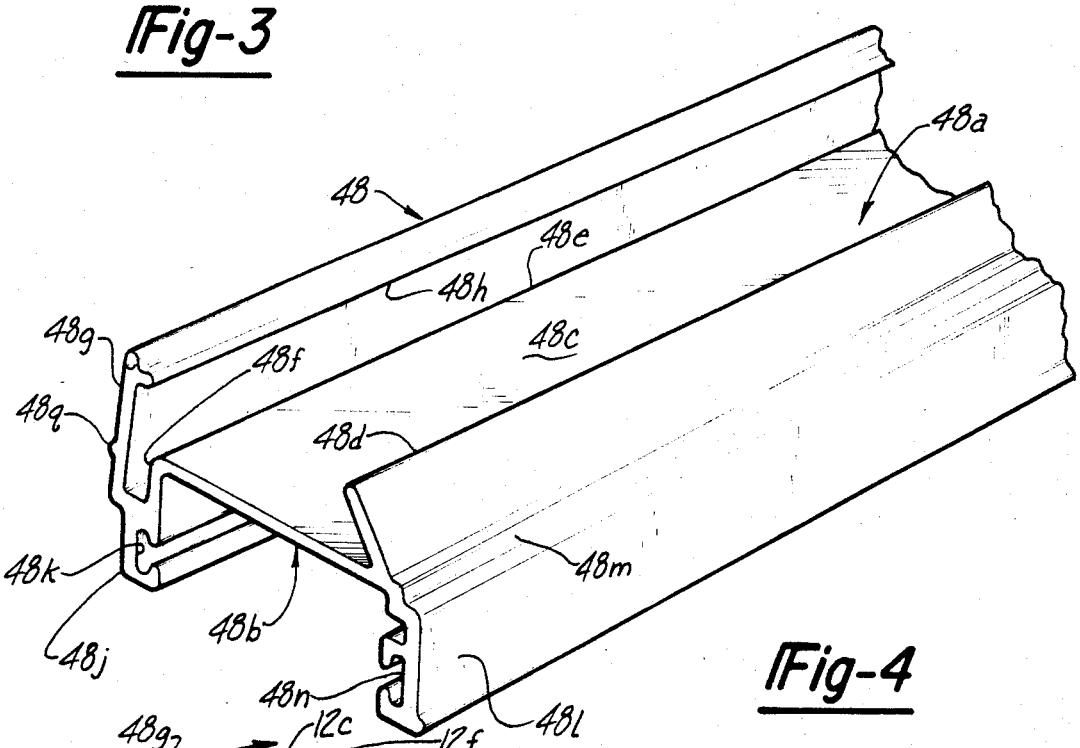
FIG. 4 is a fragmentary perspective view of a cladding and sealing member according to the invention.

Cladding and sealing member 50, as best seen in FIG. 3, is generally similar to cladding and sealing member 48 with the exception that sealing portion **50*l* has a generally U configuration as opposed to the simple flange configuration of member 48. Member 50 is snappingly secured to the underface 16*b* of header 16, in a manner similar to the described securement of member 48 to jamb member 12, by inserting fulcrum rib portion 50*d* in a complimentarily angled slot 16*a* in header 16 and thereafter pivoting member 50 about fulcrum rib portion 50*d* to cam the leading edge of flange portion 50*g* over the corner of header 16 and snap lip portion 50*h* into a slot 16*d* formed in the edge surface 16*e* of the header. Sealing members 60 are received in opposed sealing grooves 50*k* and 50*n* to slidably and sealingly engage the opposite side faces of top frame member 28 of sliding door assembly 20 as assembly 20 moves along track 47**.

Cladding and sealing member 52 is generally similar to members 48 and 50 with the exception that the sealing portions are omitted at the front face of the member and a flange portion **52*p* extends from the front face adjacent one end of the main body portion to assist in the fixed mounting of fixed door assembly 22** in the door opening.

Figure 2:
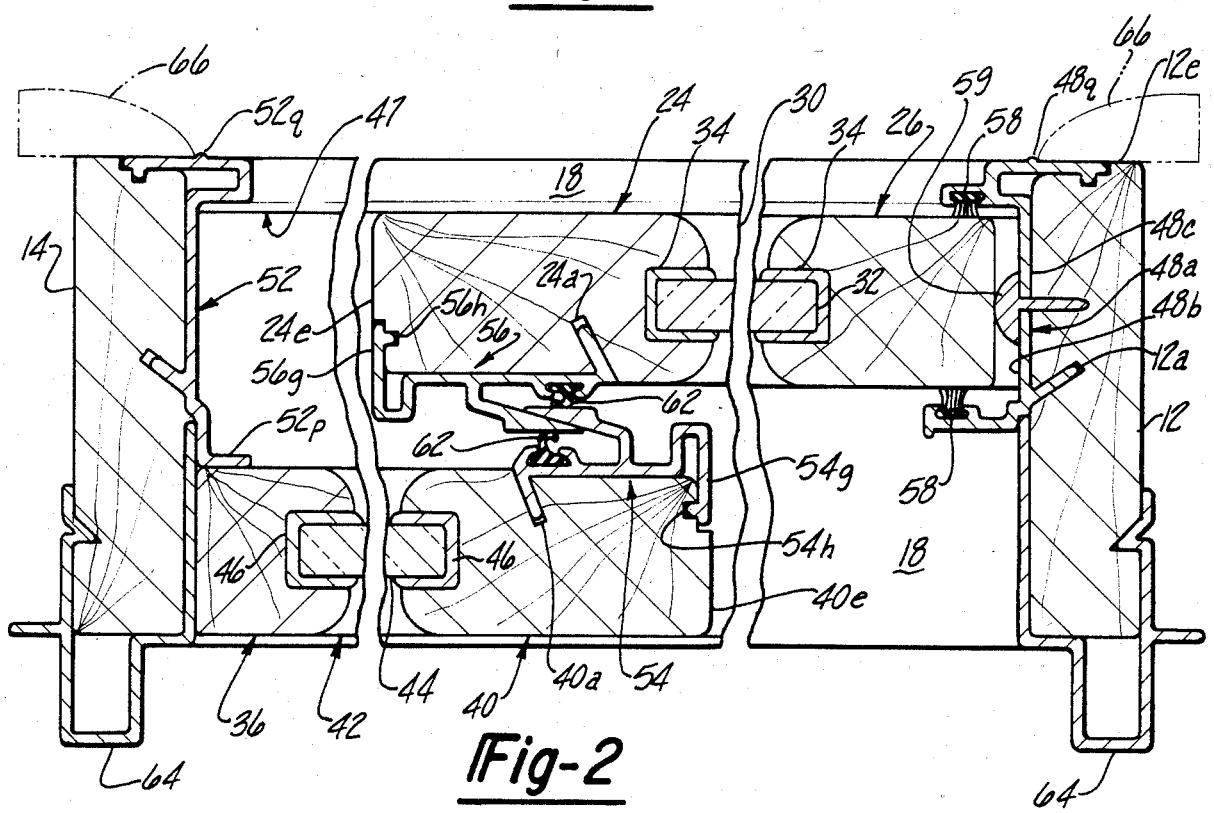
FIGS. 2 and 3 are cross-sectional views taken on lines 2—2 and 3—3 of FIG. 1.

Cladding and sealing members 54 and 56 are identical and are generally similar to members 48, 50 and 52 with the exception that they are intended for sealing coaction with each other rather than with a sliding door and the particular sealing construction formed on the front face of the members is reflective of this coacting function. Specifically, each strip 54, 56 includes a sealing groove 54*q*, 56*q* formed directly on the front face of the strip and a weatherstrip portion 54*r*, 56*r* extends from the front face of the strip. Each weatherstrip portion 54*r*, 56*r* includes a wedge portion 54*s*, 56*s* generally overlying the respective groove 54*q*, 56*q* and defining an inner longitudinal sealing surface 54*t*, 56*t* and an outer longtiduinal sealing surface 54*u*, 56*u*. Members 54 and 56 are snappingly secured to the confronting faces of door members 24 and 40 by inserting rib fulcrum portions 54*d*, 56*d* in complimentarily angled slots 24*a*, 40*a* and camming flange portions 54*s*, 56*s* over the respective corners of the frame members to snappingly seat lip portions 54*h*,56*h* in the complimentary slots formed in the edge surfaces 24*e*,40*e*. Thus secured, members 54 and 56 clad the confronting interfaces of frame members 24 and 40 and sealingly coact as sliding door 20 is moved to its closed position to provide weathersealing at the interface between the door units. Specifically, as door 20 approaches its closed position, as seen in FIG. 2, surfaces 54*t*, 56*t* camingly coact and slidably seal on each other and surfaces 54*u*,56*u* respectively slidably coact with seals 62 received in grooves 54*q*, 56*q*.

If desired, further cladding members 64 may be secured to jamb members 12 and 14 to complete the cladding of these members and door casings 66 may be positioned against the edges 12*e*, 14*e* of jamb members 12 and 14, with the leading edge of the casing abutted against and aligned with vertical ribs 48*q* and 52*q* on strips 48 and 52, as a finishing operation on the inside of the door assembly.

The described cladding and sealing kit will be seen to provide a simple and effective way to provide cladding and sealing for a sliding door assembly. The wooden jamb, header, and door members are premilled in a factory operation to provide the required angled slots in the side faces and the required milling and sloting in the end faces so that, when received at a building site, the premilled wooden members may be quickly erected to form the door opening and the cladding and sealing strip of the invention may be quickly snapped into position on the jamb and header members and on the confronting door frame members to quickly provide cladding and total sealing for the door assembly. The cladding and sealing members, once installed, are securely attached but may be readily removed, either to correct or modify an initial installation or to facilitate later maintenance and repair of the door assembly. Since the strips are attached without the use of the usual fastener members, they may be removed and replaced, or removed and reinstalled, without necessity of first removing fastener members and without damage to the plastic strip or to the wooden support member. Removal of strip 48 may be accomplished, for example, by a pushing or pressing force applied against cantilever flange portion 48*g* in combination with a prying force exerted under the free end of cantilever flange portion 48*g* by a blade-like member, such as a putty knife blade, inserted between the free end of portion 48*g* and milled edge 12*f* in jamb member 12. Further, since strips 48, 52, 54 and 56 may be used with either a right handed or a left handed door assembly, the number of different strips that a dealer or distributor must stock is compatible with commercial inventory requirements.

The invention cladding and sealing kit will be seen to facilitate the provision of a sliding door or window assembly which may be initially erected at low cost, is extremely attractive in appearance, may be readily maintained and repaired, which offers effective weathersealing, and which is compatible with the commerical inventory requirement of dealers and distributors.

Whereas a perferred embodiment of the invention has been illustrated and described in detail, it will be apparent that various changes may be made in the disclosed embodiment without departing from the scope or spirit of the invention.

We claim:

1. A cladding and sealing kit for use with a sliding sash construction of the type including a plurality of elongated wooden members arranged to form the frames of the fixed and sliding sashes and the jambs and header of the sash opening, said kit comprising a plurality of elongated cladding and sealing members, each cladding and sealing member formed of resilient material and including:

a. an elongated flat main body portion defining a longitudinal front face and a longitudinal rear face adapted to be placed against a longitudinal side surface of an elongated wooden member;

b. a longitudinal fulcrum rib portion extending from the rear face of said main body portion and angled toward one end of said main body portion for coaction with a complimentarily angled longitudinal slot formed in the longitudinal surface of the wooden member;

c. a longitudinal cantilever flange portion extending generally perpendicularly away from the rear face of said main body portion adjacent and one end thereof and defining a longitudinal inner face confronting said fulcrum rib portion; and d. a longitudinal lip portion formed adjacent the free end of said cantilever flange portion and extending from the inner face of said cantilever portion toward said fulcrum rib portion for coaction with a complimentary longitudinal slot formed in a longitudinal edge surface of the elongated wooden member forming a corner with the longitudinal side surface of that member, whereby said cladding and sealing members may be snappingly and removably secured to the longitudinal side surface of respective wooden members by inserting said flange rib portion into the angled slot in the longitudinal side face of the respective wooden member and thereafter pivoting said cladding member about said fulcrum rib portion to cam the leading edge of said flange portion over the corner of the respective wooden member and snap said lip portion into the slot in the edge surface of the respective wooden member.

2. A kit according to claim 1 wherein at least certain of said cladding and sealing members further include:

(e) a longitudinal flexing flange portion extending generally perpendicularly from the front face of said main body portion at said one end thereof and, (f) a longitudinal web portion interconnecting the free end of said flexing flange portion and the other end of said cantilever flange portion, whereby said flexing flange portion, said web portion, and said cantilever flange portion may resiliently and flexingly coact during securing of said cladding member to the wooden member to facilitate the camming movement of the free end of said cantilever flange portion over the corner of the wooden member for snapping engagement of said lip portion in the slot in the edge surface of the wooden member.

3. A kit according to claim 2 wherein at least certain of said cladding and sealing members further include:

g. a sealing portion defining a longitudinal sealing groove adjacent the front face of said main body portion adapted to receive a longitudinal seal for sliding coaction with a longitudinal surface on one of the sashes.

4. A kit according to claim 3 wherein at least certain of said cladding and sealing members further include:

h. another sealing portion defining another longitudinal sealing groove adjacent the front face of said main body portion in spaced, confronting relation to the first sealing groove, said confronting sealing grooves being adapted to receive longitudinal seals for respective coaction with opposite longitudinal surfaces on the sliding sash.

5. A kit according to claim 3 wherein, with respect to at least certain of said cladding and sealing members adapted for securement to confronting longitudinal surfaces at the sealing interface between the sashes:

h. said longitudinal sealing groove is defined directly on the front face of said main body portion; and i. a longitudinal weatherstrip portion extends from the front face of said main portion between said cantilever flange portion and said sealing groove and includes a wedge portion generally overlying said sealing groove and defining an inner longitudinal sealing surface for caming and sealing coaction with a similar surface on a further cladding and sealing member secured to the other sash and an outer longitudinal sealing surface for sealing coaction with the longitudinal seal received in the sealing groove of said further cladding and sealing member.

6. A kit according to claim 4 wherein said sliding sash construction comprises a sliding door assembly.

7. A sliding sash construction comprising:

a. a right hand wooden jamb member, a left hand wooden jamb member, and a wooden header member, each having an angled slot formed in a longitudinal side surface of the member and a further slot formed in the longitudinal edge surface of the member toward which the angled slot extends; and b. a plurality of cladding and sealing members formed of resilient material and each including:

1. an elongated flat main body portion defining a longitudinal front face and a longitudinal rear face adapted to be placed against a longitudinal side surface of a respective wooden member,

2. a longitudinal fulcrum rib portion extending from the rear face of said main portion and angled toward one end of said main body portion for coaction with the angled slot in the longitudinal surface of a respective wooden member,

3. a longitudinal cantilever flange portion extending generally perpendicularly away from the rear face of said main body portion adjacent said one end thereof and defining a longitudinal inner face confronting said fulcrum rib portion, and

4. a longitudinal lip portion formed adjacent the free end of said cantilever flange portion and extending from the inner face of said cantilever flange portion towards said fulcrum rib portion for coaction with the longitudinal slot in the edge surface of a respective wooden member, whereby said cladding and sealing members may be snappingly and removably secured to the longitudinal side surfaces of respective wooden members by inserting said fulcrum rib portion into the angled slot in the longitudinal side face of the respective wooden member and pivoting said cladding member about said fulcrum portion to cam the leading edge of the flange portion over the corner of the respective wooden member and snap said lip portion into the slot in the edge surface of the respective wooden member.

8. A sliding sash construction according to claim 7 and further including:

c. a fixed sash unit and a sliding sash unit having vertical wooden frame members defining faces which confront each other in the closed position of the sliding sash construction; and d. a pair of cladding and sealing members as aforedescribed adapted to be snappingly secured as aforedescribed to the respective confronting faces of the wooden members of the fixed and sliding sash units and having weatherstrip portions extending outwardly from the respective front faces of their main body portions for sealing coaction when the sliding sash construction is in its closed position.

9. A sliding door construction according to claim 8 wherein:

e. said weatherstrip portions comprise wedge portions which sealingly and camingly coact as the sliding sash unit moves to its closed position to provide weather sealing between the confronting faces of the confronting wooden members of the fixed and sliding sash units.

10. A sliding door construction according to claim 9 wherein a sealing groove is formed on the front face of the main body portion of the cladding and sealing members secured to the confronting wooden members of said sash units and a sealing surface is defined on each of said wedge portions for coaction with a sealing member received in the sealing groove of the other cladding and sealing member to assist in the weathersealing between the confronting wooden members of the sliding and fixed sash units.

11. A sliding sash construction according to claim 7 wherein:

c. at least certain of said cladding and sealing members further include a sealing portion defining a longitudinal sealing groove adjacent the front face of said main body portion adapted to receive a longitudinal seal for sliding coaction with a longitudinal surface on a sliding sash unit received in a suitable wall opening.

12. A sliding sash construction according to claim 11 wherein:

d. said certain cladding and sealing members further include another sealing portion defining another longitudinal sealing groove adjacent the front face of said main body portion in spaced confronting relation to the first sealing groove, said confronting sealing grooves being adapted to receive longitudinal seals for respective coaction with opposite longitudinal surfaces on the sliding sash unit received in the opening.

13. A sliding sash construction according to claim 12 wherein said sash construction comprises a fixed door unit and a sliding door unit received in a sliding door opening and said sliding sash unit is constituted by said sliding door unit.

14. A method of constructing a sliding sash assembly of the type including a pair of elongated wooden jamb members and an elongated header member adapted to be arranged in an opening to frame the assembly, a fixed sash unit having a wooden frame and adapted to be fixedly secured in the opening, and a sliding sash unit having a wooden frame and adapted to be slidably mounted in the opening for movement between an open position and a closed position in which vertical wooden members of the respective sash units confront each other to provide a sealing interface between the fixed sash unit and the sliding sash unit, said method comprising the steps of:

a. providing an angled longitudinal slot in a longitudinal surface of each of said jamb and header members;

b. providing a longitudinal slot in the longitudinal edge surface of each of said jamb and header members toward which the respective angled slot extends;

c. erecting said jamb and header members to form the opening;

d. forming three cladding and sealing strips with lengths respectively corresponding to the lengths of said jamb and header members with each strip comprising:

1. an elongated flat main body portion defining a longitudinal front face and a longitudinal rear face, 2. a longitudinal fulcrum rib portion extending from the rear face of said main body portion and angled toward one end of said main body portion, 3. a longitudinal cantilever flange portion extending generally perpendicularly away from the rear face of said main body portion adjacent one and thereof and defining a longitudinal inner face confronting said fulcrum rib portion, and 4. a longitudinal lip portion formed adjacent the free end of said cantilever flange portion and extending from the inner face of the said cantilever flange portion toward said fulcrum rib portion, and e. inserting the fulcrum rib portion of a respective strip into the angled slot in the longitudinal surface of a respective jamb or header member and pivoting said strip about said fulcrum rib portion to cam the leading edge of said flange portion over the corner of the respective wooden member and snap said lip portion into the slot in the edge surface of the respective wooden member, whereby to snappingly and removably secure the respective strips to the respective wooden members and provide cladding for these members.

15. The method of claim 14 including the further steps of:

f. forming confronting sealing portions adjacent the front face of the strip adapted for coaction with one of said jamb members and the strip adapted for coaction with the header member; and g. installing a fixed sash unit and a sliding sash unit in said sash opening with the upper frame member of the sliding sash unit adapted to be slidably sealingly received between the confronting sealing portions of the strip snappingly secured to the header member and the leading vertical member of the sliding sash unit adapted to be received in the closed position of the sliding sash assembly between the confronting sealing portions of the strip snappingly secured to the one jamb member.

16. The method according to claim 15 and including the further steps of:

h. providing angled slots in the confronting longitudinal vertical surfaces of the confronting frame members of the sliding and fixed sash units, i. providing longitudinal slots in the edge surfaces of these confronting frame members toward which the respective angled slots extend, j. forming two further cladding and sealing strips as aforedescribed, k. snappingly securing the strips as aforedescribed to the confronting surfaces of the confronting wooden frame members of the sliding and fixed sash units to respectively clad these surfaces of these wooden frame members.

17. A method according to claim 16 and including the further steps of:

l. forming longitudinal weatherstrip portions on the respective outer faces of said further cladding and sealing strips so that said weatherstrip portions may coact as the sliding sash unit reaches its closed position to provide weathersealing between the interface between the fixed and sliding sash units.

18. A method according to claim 15 wherein said sliding sash unit comprises a sliding door assembly.

* * * * *